US010493464B2

(12) United States Patent
Hoffman

(10) Patent No.: US 10,493,464 B2
(45) Date of Patent: Dec. 3, 2019

(54) ROTARY MILL

(71) Applicant: Aaron Engineered Process Equipment, Inc., Bensenville, IL (US)

(72) Inventor: Jeffrey R. Hoffman, Schaumburg, IL (US)

(73) Assignee: AARON ENGINEERED PROCESS EQUIPMENT, INC., Bensenville, IL (US)

( * ) Notice: Subject to any disclaimer, the term of this patent is extended or adjusted under 35 U.S.C. 154(b) by 1355 days.

(21) Appl. No.: 14/575,349

(22) Filed: Dec. 18, 2014

(65) Prior Publication Data

US 2016/0175849 A1 Jun. 23, 2016

(51) Int. Cl.
*B02C 17/18* (2006.01)
*B02C 17/04* (2006.01)

(52) U.S. Cl.
CPC ..... *B02C 17/186* (2013.01); *B02C 17/04* (2013.01); *B02C 17/1855* (2013.01)

(58) Field of Classification Search
CPC .... B02C 17/04; B02C 17/186; B02C 17/1855
USPC ..... 241/15
See application file for complete search history.

(56) References Cited

U.S. PATENT DOCUMENTS 1,235,868 A * 8/1917 Williams ..... B02C 13/26 241/51
1,312,173 A * 8/1919 Gerlach ..... C10L 11/04 201/3
1,656,575 A * 1/1928 Stone ..... C07C 65/34 552/268
1,718,552 A * 6/1929 Fluker ..... B02C 17/04 241/176
1,751,525 A * 3/1930 Mullin ..... B02C 17/04 241/183
1,894,577 A * 1/1933 Wells ..... B02C 17/04 241/171

(Continued)

FOREIGN PATENT DOCUMENTS

CN 201543470 U 8/2010
CN 201969598 U 9/2011

(Continued)

*Primary Examiner* — Adam J Eiseman
*Assistant Examiner* — Smith Oberto Bapthelus
(74) *Attorney, Agent, or Firm* — Barnes & Thornburg LLP; G. Peter Nichols

(57) ABSTRACT

A rotary milling system includes a rotatable cylinder, a discharge grate, a discharge housing surrounding the grate, a valve moveable between an open and closed position being in fluid communication with the discharge housing, and a conveying pipe extending from the valve. The cylinder can include grinding media for abrading a product when the cylinder is rotated. The product is suspended and ground within a liquid medium. Upon conclusion of the milling, the valve is opened to allow the liquid medium and milled product to pass through the discharge housing and the conveying pipe. The liquid medium can flow back and forth through the grate during the milling operation, with the valve preventing discharge before conclusion. A liquid-drawing apparatus can be used to draw the milled product through the conveying pipe into a separator tank after opening the valve.

19 Claims, 8 Drawing Sheets

(56) References Cited

U.S. PATENT DOCUMENTS 1,903,166 A * 3/1933 Bryant ..... B02C 17/04 241/171
1,914,184 A * 6/1933 Traquair ..... B02C 17/04 241/137
1,975,501 A * 10/1934 Carman ..... B02C 17/04 241/171
1,986,103 A * 1/1935 Cole ..... B02C 17/04 241/171
2,098,054 A * 11/1937 McBerty ..... C22B 34/125 241/15
2,174,008 A * 9/1939 Mow ..... C07C 29/80 202/238
2,534,656 A * 12/1950 Bond ..... B02C 25/00 137/3
2,675,967 A * 4/1954 Mote ..... B02C 17/18 241/171
2,678,167 A * 5/1954 Weston ..... B02C 17/04 241/183
2,681,210 A * 6/1954 Schaefer ..... B01F 9/02 241/176
2,715,466 A * 8/1955 Esposito, Jr. ..... B01D 33/073 210/193
2,805,827 A * 9/1957 Pierce ..... B02C 17/00 241/171
2,818,220 A * 12/1957 Woody ..... B02C 17/14 241/153
2,841,339 A * 7/1958 Gilmore ..... B02C 17/04 241/17
2,853,244 A * 9/1958 Plimpton ..... B02C 13/00 241/135
2,912,174 A * 11/1959 Bidwell ..... B02C 19/0056 162/261
2,922,586 A * 1/1960 Hardinge ..... B02C 17/04 241/172
3,064,906 A * 11/1962 Daman ..... B02C 17/18 241/171
3,160,395 A * 12/1964 Reising ..... B01F 9/02 220/62.11
3,204,878 A * 9/1965 Peacock ..... B02C 17/10 241/15
3,253,344 A * 5/1966 Van Gelder ..... F26B 3/205 219/618
3,261,690 A * 7/1966 Wayne ..... B02C 9/00 426/417
3,428,260 A * 2/1969 Feder ..... B26D 1/38 241/15
3,523,015 A * 8/1970 Grady ..... C21B 3/08 65/141
3,593,928 A * 7/1971 Friedland ..... B01F 3/1271 241/14
3,737,285 A * 6/1973 Hicks, Jr. ..... C07C 4/02 110/229
4,121,968 A * 10/1978 Wells ..... D21C 9/06 162/290
4,148,440 A * 4/1979 Eisenhauer ..... B23K 35/404 241/175
4,168,714 A * 9/1979 Bahrke ..... B08B 3/042 134/104.4
4,191,224 A * 3/1980 Bontrager ..... C04B 18/28 118/303
4,603,814 A 8/1986 Mehltretter et al.
4,734,960 A * 4/1988 Bougard ..... B02C 13/22 110/222
4,744,525 A 5/1988 De La Orden
4,801,100 A 1/1989 Orlando
4,816,289 A * 3/1989 Komatsu ..... D01F 9/133 252/502
4,867,322 A 9/1989 Bogdanov et al.
5,385,083 A * 1/1995 Toyokura ..... B02C 9/04 241/101.5
5,854,311 A * 12/1998 Richart ..... B02C 17/16 523/309
5,954,276 A 9/1999 Hintikka et al.
5,979,804 A * 11/1999 Abrams ..... B02C 19/0093 241/15
6,129,296 A * 10/2000 Campbell ..... B02C 4/06 241/225
7,152,819 B2 * 12/2006 Ford ..... B02C 17/16 241/18
7,374,115 B2 5/2008 Geiger et al.
7,534,392 B1 * 5/2009 Kodis ..... A61L 2/22 241/15
9,505,008 B2 * 11/2016 Nied ..... B02C 17/161
9,764,329 B2 * 9/2017 Hoffmann ..... B02C 17/1865
2001/0039887 A1 * 11/2001 Reddoch ..... B30B 9/12 100/117
2001/0053664 A1 * 12/2001 Czekai ..... B02C 17/16 451/85
2005/0258288 A1 * 11/2005 Dalziel ..... A61K 9/14 241/172
2008/0245265 A1 * 10/2008 Corbelli ..... B01F 3/1221 106/31.9
2011/0121115 A1 5/2011 Lang et al.
2012/0325944 A1 12/2012 Knobel
2014/0239098 A1 * 8/2014 Nakayama ..... H01F 41/0253 241/21
2015/0102139 A1 * 4/2015 Nied ..... B02C 17/161 241/12
2015/0353881 A1 * 12/2015 Minamino ..... C12M 23/58 435/99
2016/0175849 A1 * 6/2016 Hoffmann ..... B02C 17/186 241/15
2016/0250647 A1 * 9/2016 Hoffmann ..... B02C 17/10 241/46.06

FOREIGN PATENT DOCUMENTS

CN 202867565 U 4/2013
CN 202983794 U 6/2013
DE 3318826 A1 11/1984
DE 19750840 A1 6/1998
ES 2004981 A6 2/1989
RU 2291746 C1 1/2007
WO 90/07378 A1 7/1990

* cited by examiner

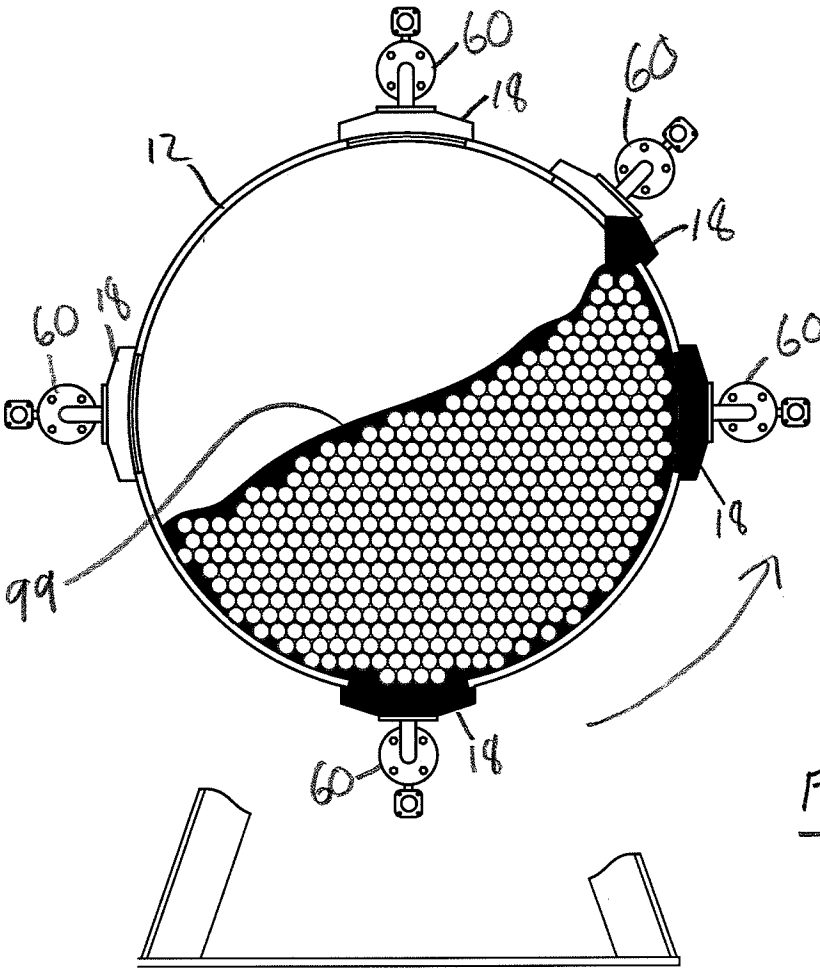
60
60
60
60
14
14
14
14
12
16
16
16

ROTARY MILL

BACKGROUND

The present invention relates to rotary mills. More particularly, the invention relates to an automated system for reliably discharging rotary mills that include liquid in the milling cylinder.

Rotary mills, also known as ball mills, pebble mills, rod mills, or tumble mills, are well known in the art. A traditional rotary mill includes a horizontal rotating cylinder that rotates about a central axis. The cylinder includes grinding media that is generally spherical, cylindrical, or another uniform shape. In the case of milling with a liquid medium, solid target materials are placed along with a liquid medium into the cylinder for milling. The cylinder is rotated, causing the grinding media to tumble along with the target material, with the grinding media abrading and impacting the solid target materials. Continued rotation of the cylinder produces a milled product in the form of particles suspended in liquid media.

Upon completion of the milling process, the milled product is discharged from the cylinder. The cylinder includes an opening with a solid cover that can be manually removed and replaced with a discharge grate, which will retain the grinding media but allow the milled product to pass through.

In the case of a wet milled product, the cylinder can remain stationary if the liquid suspending the product is a low-viscosity fluid, the liquid can flow past the media due to gravity. If, however, the liquid is a non-Newtonian or a high-viscosity liquid, the cylinder can be rotated to discharge the milled product.

Alternatively, the grinding media and milled product can be dumped from the cylinder without the use of a grate, and subsequently separated by a grate, filter, or vibrating sifter.

The rotary mill also includes a discharge housing that surrounds the rotating cylinder to define an annular space between the cylinder and the housing. The housing also includes a collection hopper at its bottom. When the milled product is discharged, as described above, the milled product will enter the annular space and fall into the hopper.

However, the above discharge process can result in dirty conditions, with milled product adhering to the inner surface of the housing as well as the outside of the cylinder. Retrieval of the milled product from the discharge housing can also result in milled product entering the surrounding area. These conditions can reduce the amount of milled product recovered, as well as lead to cross-contamination issues and cleaning problems. In the case of liquid milling, the operator must make and break a liquid piped connection to the discharge housing, exposing the milled product and potential solvent vapors to the surrounding area during this break in the connection.

Accordingly, there is a need for a discharge system that can reliably deliver the milled product from the cylinder while limiting loss of milled product and exposure of the milled product to adjacent areas and operators.

SUMMARY

To address the above and other problems, a rotary milling system is provided that includes a rotatable cylinder that defines a cavity and a central longitudinal axis. A discharge grate is provided on a sidewall of the cylinder to define an opening to allow milled product to pass therethrough. A discharge housing surrounds the discharge grate and defines a cavity. A valve is connected to an outlet of the discharge housing and the valve is moveable between a closed position and an open position to selectively allow liquid medium and suspended solids therein to pass through the valve when open while preventing passage when closed. A conveying pipe is in fluid communication with an outlet side of the valve and a liquid-drawing apparatus operatively associated with the conveying pipe and disposed downstream of the discharge housing to draw liquid medium in the conveying pipe away from the discharge housing.

The system may include a rotary union connected with the conveying pipe. The system may also include a secondary pipe connected to the rotary union, wherein the rotary union couples the secondary pipe and the conveying pipe.

The system may also include a separator tank operatively coupled to the conveying pipe, wherein the liquid drawing apparatus is in fluid communication with the separator tank.

In one aspect of the system, the valve can be a ball valve, pinch-type valve, or gate-type valve. The valve may be manually or pneumatically operated between the open and closed positions.

In another aspect, the opening of the discharge grate is always open and provides fluid communication between the discharge housing and the cavity of the rotatable cylinder, allowing fluid to pass between the discharge housing and cylinder during rotation of the cylinder while blocking solid grinding media from passing through the discharge grate.

The system may include a transmission coupled to the cylinder for rotating the cylinder.

The liquid-drawing apparatus can include a vacuum coupled to the separator tank or it could include a pump connected in line with the secondary pipe. Where the liquid-drawing apparatus includes a pump, the pump can be any suitable type of pump such as a centrifugal pump, positive displacement pump, lobe pump, eccentric screw pump, rotary pump, or diaphragm pump. The conveying pipe can extend into and through the first trunion member.

In another aspect, the system can include a valve disposed in line with the secondary pipe and a delivery pipe extending from the valve and in fluid communication with a tank for housing liquid medium to be delivered to the cylinder. The delivery pipe is configured to deliver liquid medium to the cylinder through the secondary pipe and conveying pipe. The valve has a first position where the liquid delivery pipe is blocked from the secondary pipe and a second position where the liquid delivery pipe is in fluid communication with the secondary pipe. A pump can be disposed in line with the delivery pipe for pumping liquid medium from the tank toward the cylinder.

In another approach, a method for discharging milled product from a rotary mill is provided. The method includes rotating a cylinder in which a plurality of grinding media, liquid medium, and product to be milled are disposed; grinding the product to be milled to produce a milled product and suspending the milled product in the liquid medium while grinding; discharging the liquid medium and milled product through a discharge grate disposed on the cylinder from the cylinder into a discharge housing that surrounds the discharge grate; opening a valve that is connected to a conveying pipe, wherein the valve is in fluid communication with the discharge housing and the conveying pipe to permit fluid to flow from the discharge housing to the conveying pipe; discharging the liquid medium and milled product from the discharge grate into the conveying pipe; and actuating a liquid-drawing apparatus to draw the liquid medium and milled product out of and away from the housing and through the conveying pipe.

The method can include rotating the cylinder while the valve is open and the liquid-drawing apparatus is actuated.

The method also may include transferring liquid medium back and forth between the discharge housing and the cylinder through the grate while rotating the cylinder. During this operation, the valve may be open or closed while transferring liquid medium back and forth through the grate.

In one aspect of the method, the cylinder, discharge housing, discharge grate, conveying pipe, and valve rotate together about a central axis. The rotation of the cylinder, discharge housing, discharge grate, conveying pipe, and valve may be relative to a stationary secondary pipe and separator tank. The secondary pipe may be coupled to the conveying pipe via a rotary union.

In another aspect of the method, the liquid-drawing apparatus is a pump connected in line with the secondary pipe.

BRIEF DESCRIPTION OF THE DRAWINGS

FIG. 6 is a cross-sectional side view of the rotatable cylinder showing several positions of the rotating cylinder with the liquid medium and grinding media moving within the cylinder during rotation.

DETAILED DESCRIPTION

Figure 1:
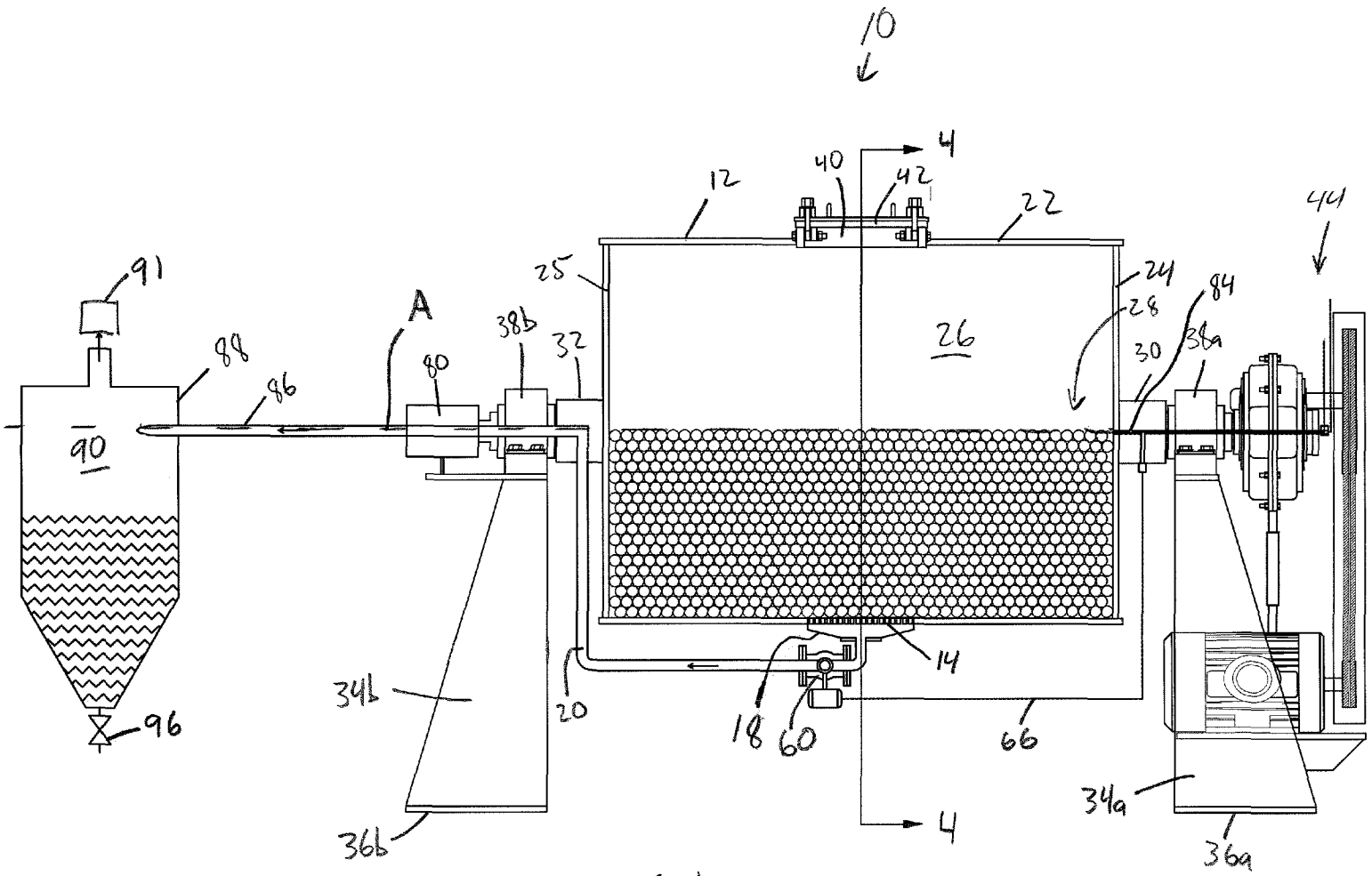
FIG. 1 is a front partial sectional view of a rotary milling system having a rotatable cylinder, conveying pipe, rotary union, stationary secondary pipe, and separator tank.

Referring now to the drawings, FIGS. 1-7B illustrate a rotary mill system 10 for milling a desired product. The system 10 includes a rotatable cylinder 12, a discharge grate 14 in the side of the rotatable cylinder 12, a liquid-tight housing 18 mounted to the cylinder 12 and surrounding the grate 14, and a conveying pipe 20 for discharging milled product from the cylinder 12.

With further reference to FIG. 1, the cylinder 12 includes a generally cylindrical sidewall 22 extending between a first end wall 24 and a second end wall 25. The sidewall 22 and end walls 24 and 25 define a cavity 26 having a longitudinal central axis A. The cylinder generally includes grinding media 28 disposed within the cavity 26 for performing a traditional rotary milling operation. The amount of grinding media 28 depends on the needs of the user. For example, the cavity 26 could be approximately 50% full of grinding media 28 by volume. Of course, other amounts, such as 30-60%, could also be used.

The grinding media 28 may be any suitably hard material, such as carbon steel, stainless steel, tungsten carbide, alumina, zirconia, porcelain, or the like. The grinding media can have different sizing as necessary. For example, in one form, the grinding media can be between ¼ inches in diameter to 1 inch in diameter. Of course, it could also be as small ⅛ inch or as large as 3 inches in diameter. The grinding media 28 is preferably a uniform size; however, the media size used in a particular operation could be different, where some of the media could be, for example, 1 inch in diameter with others being 2 inches in diameter. These sizes are merely exemplary and it will be appreciated that various other sizes of the grinding media could also be used.

The cylinder 12 also includes a first trunion 30 and a second trunion 32 extending outwardly from the end walls 24 and 25, respectively, along the central axis A. The trunions 30 and 32 support the cylinder 12 for rotating. More specifically, the system 10 includes a pair of vertical support members 34*a*, 34*b* each having a base 36*a*, 36*b* for contacting a support surface such as a floor and a bearing 38*a*, 38*b* for engaging and supporting the trunions 30 and 32 for rotation therein.

The cylinder 12 further includes a loading opening 40 extending through the sidewall 22 for delivering grinding media 28 or the product to be milled. An access hatch or loading cover 42 can be mounted over the opening 40 for sealing the opening 40 in a manner known in the art. The loading opening 40 can be diametrically opposed from the discharge grate 14 on the opposite side of the cylinder 12. However, other locations of the loading opening 40 in the sidewall 22 could be used.

Figure 2B:
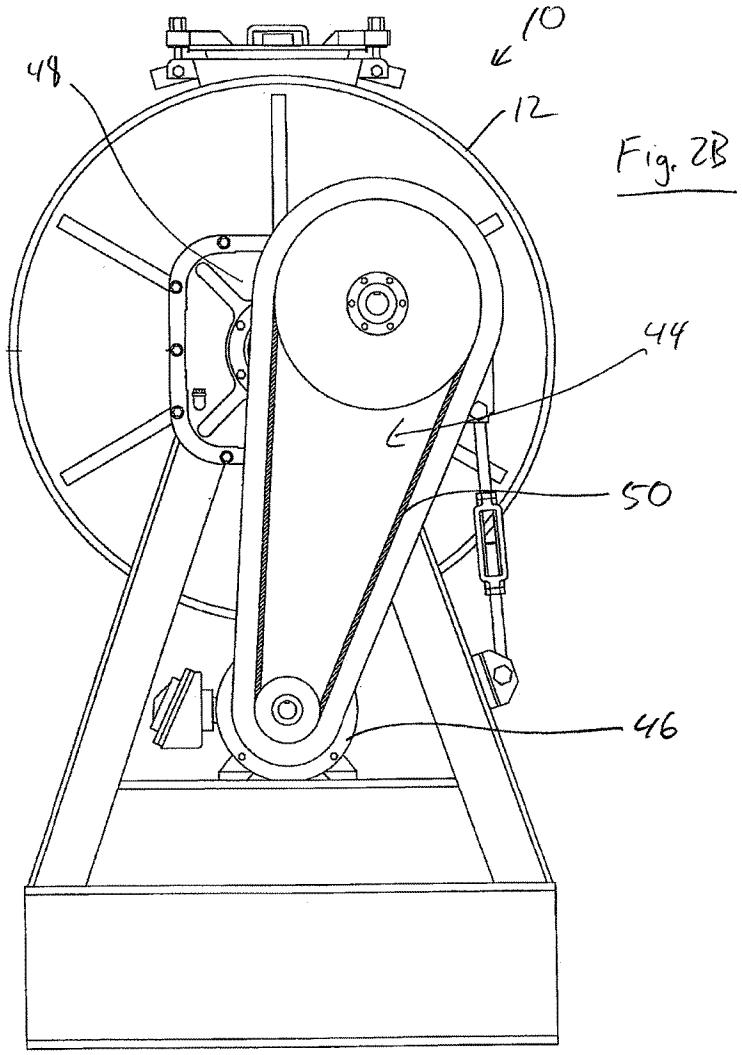
FIG. 2B is a side view of the transmission portion of the rotary milling system.
Figure 2A:
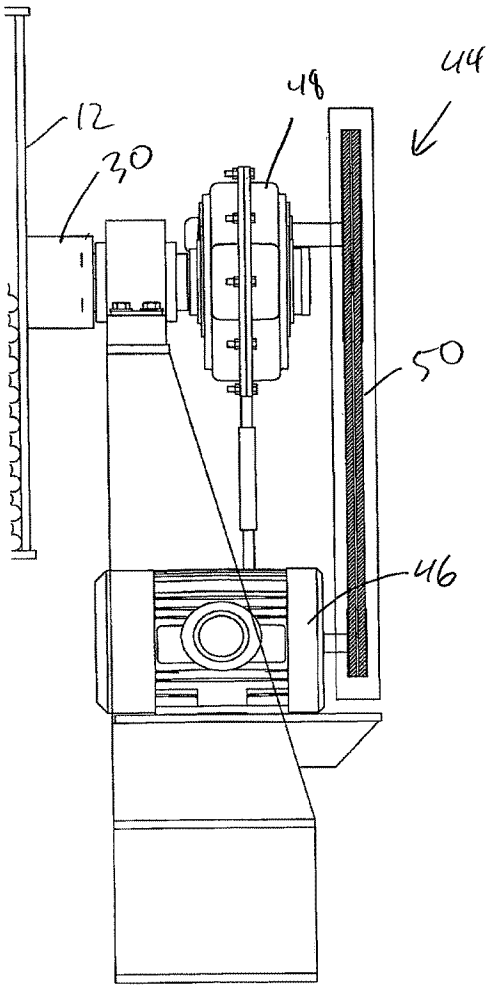
FIG. 2A is a front view of a transmission portion of the rotary milling system.

Turning to FIGS. 2A and 2B, the system 10 includes a transmission portion 44, including a motor 46, gear reducer 48, and belt 50. The gear reducer 48 is operatively coupled to the first trunion 30. The transmission portion 44 can generally operate and be controlled in a manner known in the art to rotationally drive the cylinder 12 through the connection between the gear reducer 48 and the first trunion 30.

Referring back FIG. 1, the discharge grate 14 is provided on the sidewall 22 of the cylinder 12. The discharge grate 14 is configured with openings 52 that are sized to retain the grinding media 28 within the cavity 26, while allowing the milled product to pass through the openings 52. In one form, the openings 52 can be in the form of slots approximately 0.25 inches wide. However, it will be appreciated that other opening sizes could be used to retain the grinding media 28 while allowing the product to pass.

Figure 3:
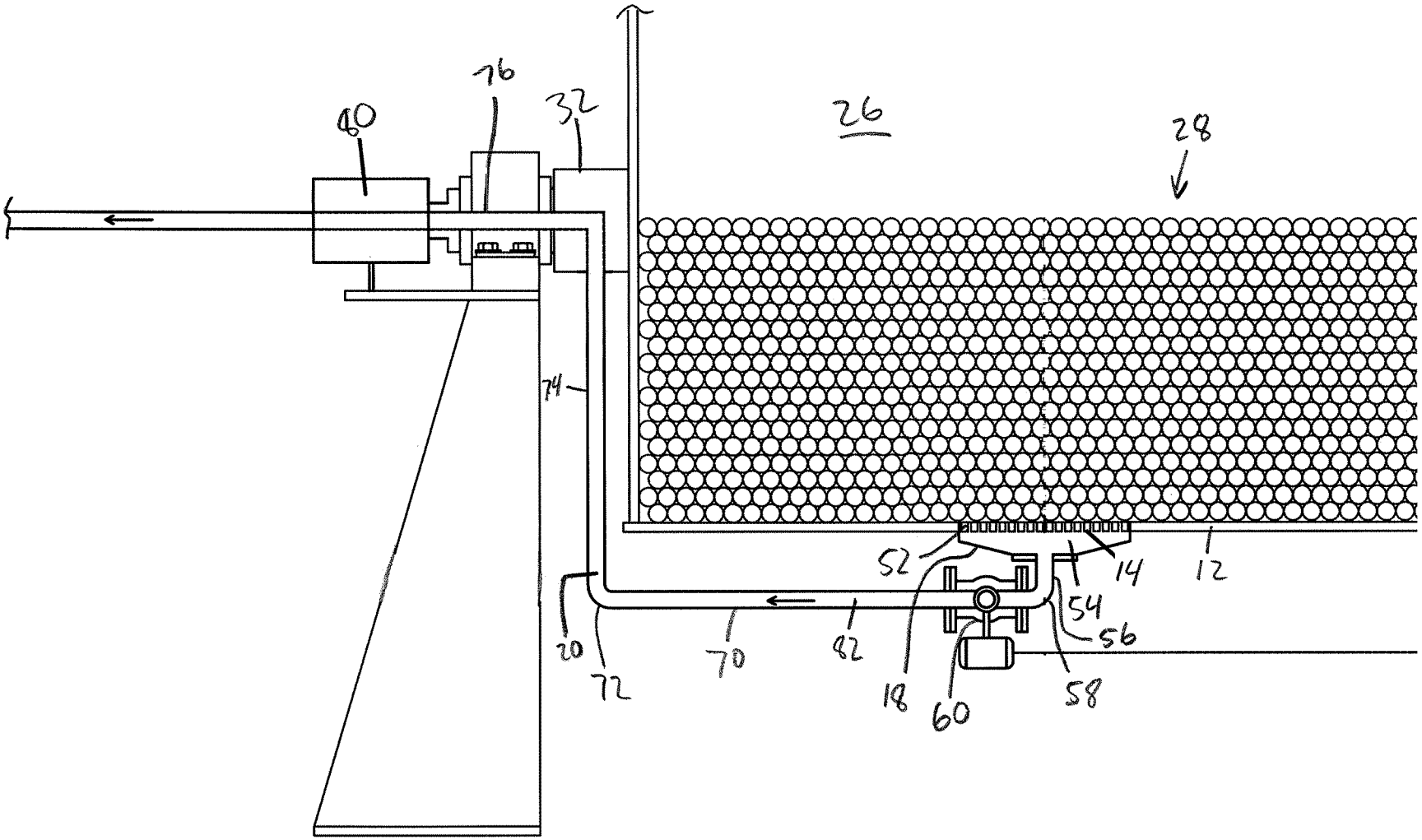
FIG. 3 is a front partial sectional view of a discharge grate, discharge housing, and conveying pipe of the rotary milling system.
Figure 4:
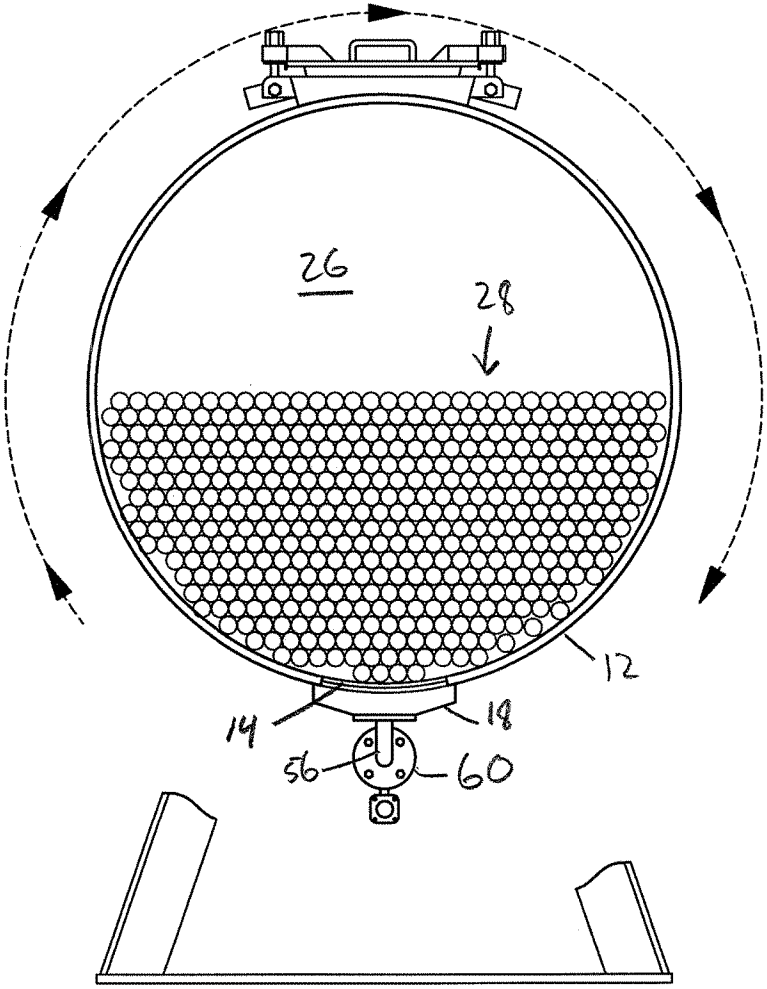
FIG. 4 is a cross-sectional side view of the rotatable cylinder and the discharge grate taken along line 4-4 of FIG. 1.

With reference to FIGS. 3 and 4, the housing 18 surrounds the discharge grate 14 to create a liquid-tight seal between the housing 18 and the cylinder 12. Accordingly, the housing 18 may be attached to the sidewall 22 of the cylinder 12. The liquid-tight seal between the housing 18 and the cylinder 12 helps to limit milled product that is suspended in the liquid medium from escaping to the adjacent area or onto the outer surface of the cylinder 12 outside the housing 18. Thus, the cylinder 12 and the surrounding environment may be kept cleaner relative to a housing surrounding the entire cylinder 12. A cavity 54 is defined by the space between the housing 18 and the cylinder 12 into which milled product and liquid can be temporarily stored after passing through the openings 52 in the grate 14.

The housing 18 further includes an outlet pipe 56 extending outward therefrom and generally perpendicular to the grate 14. The outlet pipe 56 is liquid-tight with the housing cavity 54 and open to the housing cavity 54. Liquid medium and milled product within the cavity 54 will therefore flow into outlet pipe 56 without leaking into surrounding areas.

The outlet pipe 56 includes a bend 58 of approximately 90 degrees such that the outlet pipe 56 extends generally parallel to the axis A.

The grate 14 remains open to the cavity 54 of the housing 18 during milling, such that the product and liquid medium within the cylinder 12 will be able to flow through the grate 14 in both directions during milling. However, the liquid medium and product will be prevented from flowing beyond the housing 18 and pipe 56 during the milling process as further described below.

With reference to FIGS. 1, 3, and 4, the system 10 further includes a liquid-tight valve 60 attached to the outlet pipe 56 after the bend 58. The valve 60 could be a ball valve, a pinch-type valve, or a gate-type valve. The valve 60 is moveable between an open and closed position. In the closed position, the liquid medium and product will be retained within the housing cavity 54, pipe 56, and cylinder 12. The valve 60 remains closed during the milling process, such that the medium and product can flow back into the cylinder 12 as it is rotated for additional milling. Accordingly, the milled product and liquid medium that flows into the housing 18 isn't trapped in the housing and prevented from additional milling, even though it may flow past the grate 14 multiple times during milling. The valve 60 ensures that milled product and liquid medium will not progress further into the system until such time as discharge is desired. The valve 60 is positioned between the outlet pipe 56 and the conveying pipe 20, such that when the valve is opened, liquid medium and milled product will flow through the outlet pipe 56 and into the conveying pipe 20 for further processing.

When discharge is desired, the valve 60 is opened, allowing the milled product and liquid medium to travel out of the housing 18 and cylinder 12 through the outlet pipe 56 and past the valve 60. The valve 60 can be manually actuated to move it between the open and closed positions. Alternatively, the valve 60 can be automatically actuated.

In the case of manual operation, an operator can be positioned adjacent the housing 18 with limited interaction with the liquid medium and milled product. In the case of automated operation, the operator can be positioned remotely to open and the close the valve 60 likewise limiting interaction with the liquid medium and milled product.

An automated valve 60 can be pneumatically activated in a manner known in the art. The pneumatic pressure can be provided by a supply line 66 (shown in FIG. 1) extending radially from the first trunion 30, as well as longitudinally through the first trunion 30 to an air supply source (not shown).

With reference to FIGS. 1 and 3, the liquid medium and milled product can be delivered for further processing from the housing 18 through the outlet pipe 56 and past the valve 60 via the conveying pipe 20. The conveying pipe 20 is therefore in fluid communication with the housing 18 when the valve 60 is open. For example, the conveying pipe 20 is mounted or connected to the valve 60 at a location away from the discharge grate 14 and the cylinder 12. The conveying pipe 20 has a generally circular cross-section and includes a longitudinal portion 70 extending generally parallel to the central axis A of the cylinder 12. The conveying pipe 20 further includes a curved elbow portion 72 extending from the longitudinal portion 70 and transitioning into a radial portion 74, which extends toward the central axis of the cylinder 12. The radial portion 74 is coupled with the second trunion 32 at a point generally along the central axis A of the cylinder 12. The radial portion 74 of the pipe 20 transitions into an axial portion 76 that extends along the central axis A of the cylinder 12 and into a rotary union 80. As a whole, the pipe 20 defines a passageway 82 having a central axis and extending through the pipe 20. The passageway 82 is in fluid communication with the housing cavity 54 when the valve 60 is open, so that liquid medium and milled product can be conveyed from the housing 18 through the pipe 20.

Because the housing 18 remains open to the cylinder 12 during milling and discharge, the pressure within the housing 18 and cylinder 12 is generally the same. The housing 18 does not therefore require individual pressure control and does not require the use of an additional check valve or bleed valve to maintain a desired pressure within the cavity 54 or to operate as a vacuum breaker. Vacuum prevention in the cylinder 12 and housing 18 can be accomplished by way of a vent line 84 extending through the trunion 30 and into the cylinder 12.

Figure 5:
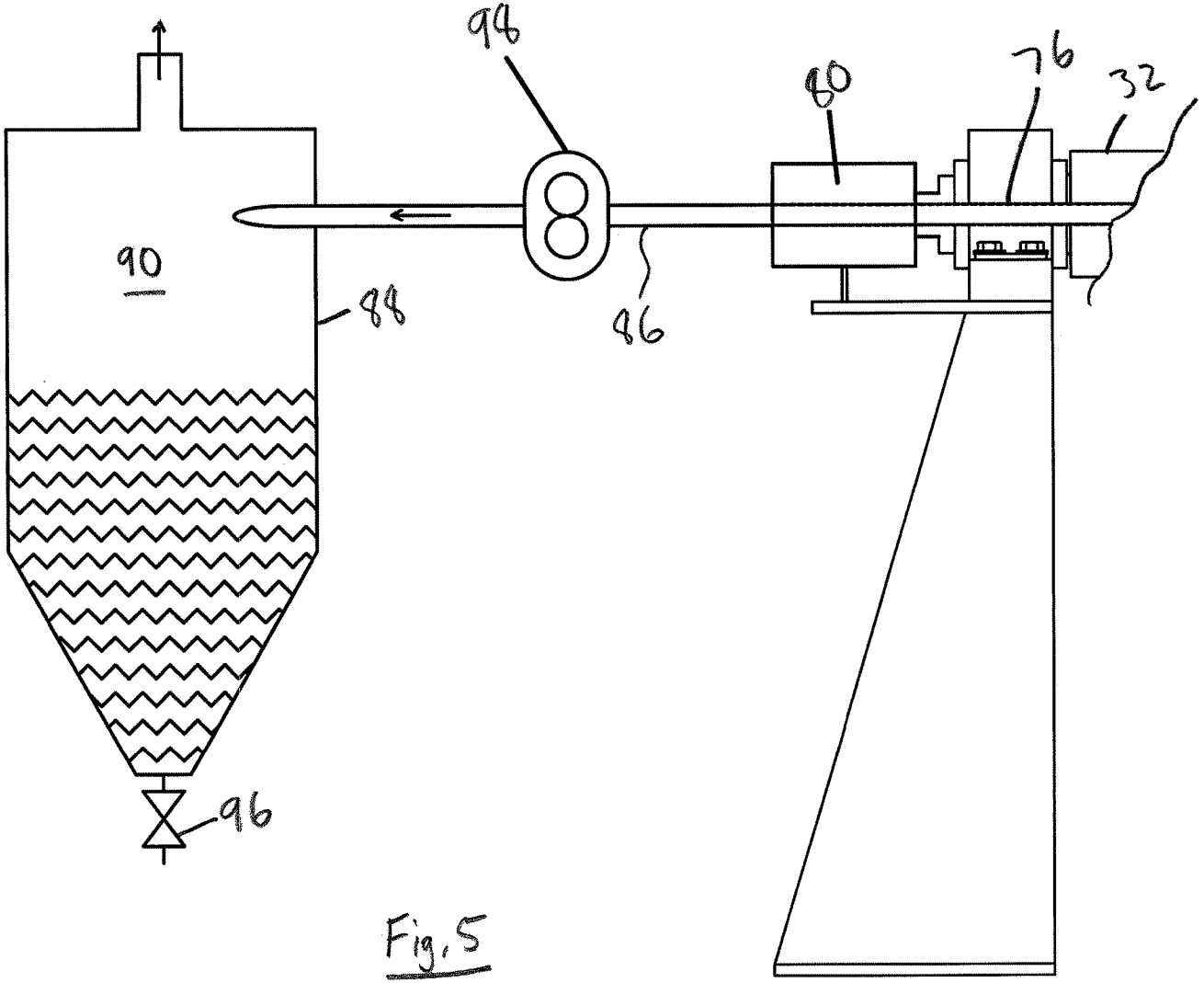
FIG. 5 is a front view of an alternative embodiment of the secondary pipe and separator tank of the rotary milling system.

With reference to FIGS. 1 and 5, the system 10 further includes a secondary pipe 86 extending axially from the rotary union 80 and into a separator tank 88. The separator tank 88 is in the form of a liquid-air separator tank. The secondary pipe 86 is fluidly coupled to the axial portion 76 of the conveying pipe 20 via the rotary union 80 in a manner known in the art. The separator tank 88 defines a cavity 90 for receiving liquid medium and milled product that has been conveyed form the conveying pipe 20 and through the secondary pipe 86. The separator tank 88 can be connected to a blower or vacuum 91. FIG. 1 illustrates that the blower or vacuum 91 is connected at the top of the tank 88. The blower or vacuum 91 can provide a negative pressure to the tank 88 as well as the secondary pipe 86 and conveying pipe 20 for drawing the milled product toward the tank 88.

For the liquid discharge of liquid medium and milled product, the tank 88 includes a valve 96 mounted to the bottom of the tank 88. The separator tank 88 can be a cyclone separator, which can separate the milled product from the liquid. The milled product can be vacuumed out of the tank 88 through the blower or vacuum 91 mounted at the top of the tank 88, and the valve 96 will release the liquid from the tank 88.

In an alternative approach, and with reference to FIG. 5, the system 10 can include a pump 98 mounted in line with the stationary secondary pipe 86 between the separator tank 88 and the rotary union 80. The pump 98 can be in the form of a positive displacement or centrifugal pump, or any pump with an eccentric screw, rotary, diaphragm, lobe, or the like. This type of pump 98 is beneficial for liquid discharge in that it can provide an alternative method for discharging the milled product by pumping the liquid medium in which the milled product is suspended. This is generally not available for discharging dry milled product.

Accordingly, the use of the pump 98 makes the vacuum 91 attached to the top of the separator tank 88 redundant. Thus, when the pump 98 is used, it can be used without the vacuum 91. However, if desired, the vacuum 91 and pump 98 could be used together. If no vacuum is mounted to the top of the tank 88, the top of tank 88 will vent.

With reference again to FIG. 1, the cylinder 12, trunions 30 and 32, bearings 38, secondary pipe 86, rotary union 80, and the radial portion 76 of the conveying pipe 20 are coaxially aligned along the central axis A of the cylinder 12. As the cylinder 12 rotates about its central axis A via the trunions 30 and 32 and bearings 38*a*, 38*b*, the coaxially aligned components, not including the secondary pipe 86 and rotary union 80, will rotate as well. The housing 18, mounted to the cylinder 12, will rotate along with the cylinder 12. The outlet pipe 56 and valve 60 will likewise rotate along with the cylinder 12. The remaining portions of the conveying pipe 20 will rotate with the cylinder 12 and remain connected via the valve 60 and outlet pipe 56 to the housing 18. The housing 18 and separator tank 88 can remain fluidly connected when the valve 60 is open through the pipes 20 and 86 while rotating. Thus, the milled product can be delivered to the tank 88 if the cylinder 12 is either rotating or stationary.

Having described the general structure of the system 10, the function of the rotary milling system 10 described above will now be described in further detail.

With the cylinder 12 in a stationary position and the valve 60 in the closed position, the loading cover 42 can be opened to allow access into the cavity 26 of the cylinder 12. The desired product to be milled can be deposited into the cavity 26 along with the desired liquid medium for subsequent milling by the system 10. Additionally, grinding media 28 can be deposited into the cavity 26 or removed from the cavity 26 depending on the needs of the user.

The liquid medium can be any suitable and known medium used for wet milling. For example, without intending to limit the liquid medium, the liquid medium can include water, solvents, emulsifiers, surfactants, alcohols, ethers, and other organic liquids as well as mixtures. The liquid medium can have varying viscosity depending on the needs and desires of the user for the milling procedure. In one approach, the liquid medium can be a low viscosity Newtonian liquid. In another approach, the liquid medium can be a high-viscosity thixotropic or shear-thinning liquid. The type of liquid medium used will affect the manner of discharging the liquid medium and milled product at the conclusion of the milling process, which will be further described below.

Once the desired amount of product and grinding media 28 are present in the cavity 26 of the cylinder 12, the loading cover 42 can be replaced on the cylinder 12 to create a seal and limit milled product from exiting the cavity 26 during the milling process. Similarly, the valve 60 is in the closed position, thereby preventing liquid medium and milled product from exiting the housing cavity 54 and cylinder 12 during the milling process. The discharge grate 14 remains open, allowing liquid medium to flow between the housing 18 and cylinder 12.

Figure 7B:
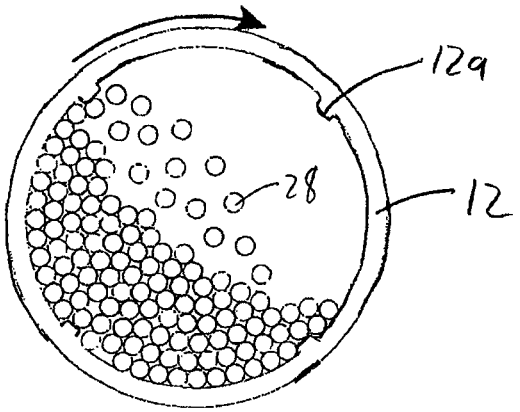
FIG. 7B is a cross-sectional view of the rotatable cylinder showing the cylinder in a rotating configuration and cataracting grinding media therein.
Figure 7A:
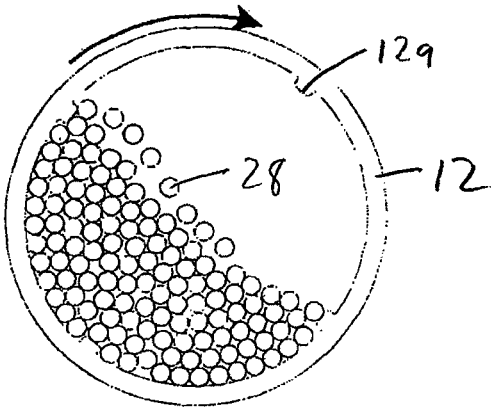
FIG. 7A is a cross-sectional view of the rotatable cylinder showing the cylinder in a rotating configuration and tumbling grinding media therein.

With reference to FIGS. 6, 7A, and 7B, with the product ready for milling, the cylinder 12 can be controllably rotated by the transmission portion 44 of the system 10 in a manner known in the art. FIG. 6 illustrates the liquid medium 99 present in the cylinder 12. FIGS. 7A and 7B shows the rotation of the cylinder without the liquid medium 99 illustrated. The cylinder 12 will rotate about its central axis A via the interface between the trunions 30 and 32 and the bearings 38. As the cylinder 12 rotates, the grinding media 28 is lifted and then tumbles back down to the bottom of the cylinder 12. This tumbling causes the grinding media 28 to abrade and impact the solid product. There are two types of action for the grinding media depending on the speed of rotation of the cylinder 12. "Tumbling" occurs at lower rotational speeds, with the grinding media 28 rolling or tumbling across the build-up of media 28 in the lower portion of the cylinder 12 and is illustrated in FIG. 7A. "Cataracting" occurs at higher rotational speeds, where the media 28 free-falls from the top of the cylinder 12 to the mass of media 28 at the bottom of the cylinder and is illustrated in FIG. 7B.

To assist in lifting the grinding media during operation, the cylinder 12 can include a plurality of longitudinally running ribs 12*a* within the cavity 26 of the cylinder 12. These ribs 12*a* can be seen in FIGS. 7A and 7B.

As stated above, and with reference to FIG. 6, the solid product to be milled is processed in a wet milling operation using the liquid medium 99 in addition to the solid product to be milled. In the wet milling operations, the solids are milled in the liquid medium 99 and the milled product is discharged as a liquid suspension or dispersion. The rotational speed of the cylinder 12 will ultimately result in either the tumbling or cataracting described above, causing the grinding media 28 to be lifted and then fall or tumble to abrade the product.

During the rotation of the cylinder 12, the housing 18 and conveying pipe 20 will rotate about the central axis of the cylinder 12. Because the conveying pipe 20 extends to couple with the trunion 32 and into the rotary union 80, the pipe 20 remains in fluid communication with the outlet side of the valve 60 mounted to the outlet pipe 56 and the secondary pipe 86 leading to the separator tank 88.

At the conclusion of the rotation of the cylinder 12 during the milling process, the cylinder 12 will contain the milled product as a wet solid in a liquid medium. Depending on the type of liquid medium used, the milled product may require additional rotation of the cylinder 12.

When the cylinder 12 is rotated, as shown in FIG. 6, the liquid medium and milled product will flow through the grate 14 and into the housing 18 when the grate 14 and housing 18 are positioned below the central axis A. As the cylinder 12 is rotated, the housing 18 will rotate upward and then ultimately downward. When the housing 18 is above the central axis A, the liquid medium and product will flow through the grate from the housing 18 back into the cylinder 12. During rotation, rotational and inertia forces will result in some liquid medium and product remaining in the housing 18, even when the housing 18 is above the central axis A, as shown in FIG. 6. FIG. 6 shows various rotational positions of the housing 18 and valve 60 and illustrates the presence, or lack thereof, of the liquid medium 99 in the housing 18 at these various rotational positions.

If the liquid has a low viscosity, the liquid medium and the solid milled product contained in the liquid can generally flow through the grinding media 28 toward the bottom of the cylinder 12 without requiring additional rotation. Gravity will cause the liquid medium and solid milled product suspended therein to flow into the housing 18 and continue to flow into the housing as the housing 18 is evacuated during discharge. If the liquid is non-Newtonian or has a high viscosity, the cylinder 12 may require additional rotation to allow the liquid medium and suspended milled product to travel toward and past the grate 14 and into the housing for discharge therefrom.

If the chosen liquid medium does not generally require additional rotation of the cylinder 12 to discharge the product, the cylinder 12 is rotatably positioned such that the discharge grate 14 is at the bottom of the cylinder 12. The liquid medium and suspended milled solids will flow into the housing 18 due to gravity. The valve 60 can be opened automatically or manually. In either case, the liquid medium and suspended milled product will pass through the grate 14 without exposing the operator or the surrounding environment to the milled product or solvent vapors. Rather, the product remains substantially contained within the housing 18 as it travels through the housing 18, outlet pipe 56, valve 60, and conveying pipe 20 to be discharged.

If the cylinder 12 is required to rotate to discharge the milled product, for reasons described above, the valve 60 can remain in the open position allowing the liquid medium and suspended milled product to pass through the grate 14 and the housing and into the conveying pipe 20. During rotational discharging procedures, the liquid medium and product will discharge through the grate 14 and the housing 18 when liquid medium and milled product are present in the housing. When the housing 18 is positioned above the central axis A, there may not be any liquid medium or milled product remaining in the housing 18 after it had fallen back into the cylinder 12. In these instances, the liquid medium and milled product will resume being discharged when the housing 18 returns to a position where gravity allows the liquid medium and milled product flow back into the housing 18.

The milled product will remain contained within the system 10 during this rotation. As described above, the valve 60 can be automatically opened via a pneumatic connection. The air delivery line 66 to produce the pneumatic connection will rotate along with the cylinder 12 during the rotation.

While the liquid medium and milled product are being discharged through the grate 14 and into the cavity 54 of the housing 18 and beyond the opened valve 60, the conveying pipe 20 can convey the milled product to the separator tank 88. More specifically, a vacuum or negative pressure can be applied to the conveying pipe 88 from the blower or vacuum 91 mounted to the tank 88 when the vacuum 91 is present in the system. The vacuum will be applied through the secondary pipe 86, the rotary union 80, and the conveying pipe 20 to pull the milled product from the housing cavity 54. This vacuuming of the milled product from the housing 18 allows for the housing 18 to be substantially smaller than the total volume of product that is discharged. In the case of the liquid discharge described herein, a slight vacuum is drawn to motivate fluid flow.

The vacuum applied through the conveying pipe 20 can occur with the cylinder 12 and housing 18 either stationary or rotating. Because the conveying pipe 20 and housing 18 rotate along with the cylinder 12, and the conveying pipe 20 is coupled to the rotary union 80, the negative pressure to retrieve the discharging product is not dependent on the cylinder 12 rotating or remaining stationary.

Similarly, in addition to or alternative to the described vacuum produced by the vacuum 91, the pump 98 can be actuated to move the liquid medium and product through the system during discharge. The pump 98 can be actuated either while the cylinder 12 is stationary or while the cylinder 12 rotating.

Accordingly, the vacuum 91 and pump 98 can generally be referred to as a liquid-drawing apparatus.

The use of a vacuum or negative pressure on the system 10, in addition to retrieving the product during the discharging process, can also be used to clean the system. The conveying pipe 20 and secondary pipe 86 can have a generally circular cross-section to limit the amount of build-up of product between the cylinder 12 and the tank 88.

Moreover, the use of negative pressure or a vacuum through the system 10 also limits instances of milled product escaping past a seal and into the surrounding area or into contact with an operator. Rather, the negative pressure will continue to pull milled product back into the system 10 in the event of a leak in one of the seals, in contrast to a system that forces air through a passageway that would push milled product out of a leaking seal or joint and into the surrounding area.

Additionally, to prevent build-up of product within the conveying pipe 20, rotary union 80, and secondary pipe 86, these components can be made from tri-clamp sanitary connections that retain little milled product, and can be broken down and easily cleaned.

At the conclusion of the retrieval process, the valve 60 can be closed, manually or automatically, to allow for another milling operation. The milled product can be retrieved from the separator tank 88 in a manner known in the art.

In the above description, the system 10 has been described as having liquid medium within the cylinder 12. The liquid medium can be added to the cylinder 12 via the loading opening 40, along with the grinding media and product to be milled.

Figure 8:
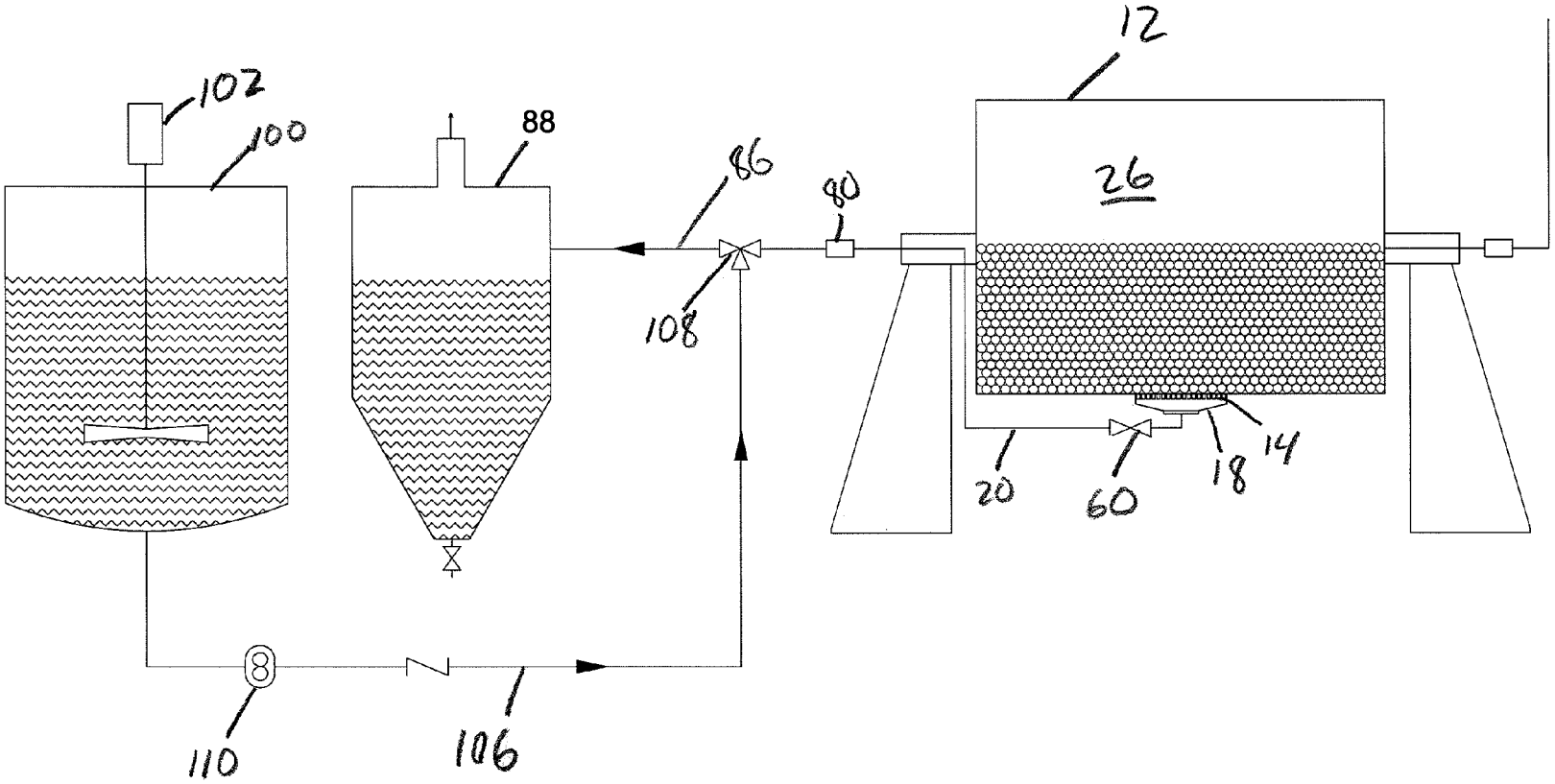
FIG. 8 is a front view of an alternative embodiment of the system including a liquid medium delivery pipe connected to the secondary pipe via a valve for delivering liquid medium into the cylinder through the discharge housing.

In another approach, and with reference to FIG. 8, the liquid medium can be provided through the secondary pipe 86 and conveying pipe 20.

In this approach, the system 10 includes a second tank 100. The second tank 100 can be referred to as a pre-mix tank, where the liquid medium is present in the tank 100 and the product to be milled can be added to the tank 100, as well. A mixer 102 is operable to mix the liquid medium with the product to be milled. This is possible when the product to be milled is initially fine enough to be pre-mixed and pumped along with the liquid medium through the secondary pipe 86 and conveying pipe 20. In some instances, however, the product to be milled may be too large to stay in suspension within the liquid medium. In this case, the product to be milled can still be added to the cylinder 12 through the loading opening 40 with the liquid medium supplied from the tank 100.

The system 10 includes a medium delivery pipe 106 that extends generally from the bottom of the tank 100 and intersects with the secondary pipe 86 at a location between the rotary union and the separator tank 90. The system includes a three-way valve 108 disposed on the secondary pipe 86 at the intersection of the secondary pipe 86 and the delivery pipe 106. The three-way valve 108 is operable to allow for liquid to flow from the conveying pipe 20 through the secondary pipe 86, through the valve 108, and toward the separator tank 90 during discharge. In this position, the valve 108 prevents liquid from flowing into the delivery pipe 106. The valve 108 is also operable to allow liquid to flow from the tank 100, through the delivery pipe 106, through the valve 108, and further through the secondary pipe 86 toward the conveying pipe 20 and ultimately to the cylinder. In this position of the valve 108, liquid will not flow through the valve 108 toward the separator tank 90.

The system 10 also includes a second pump 110 disposed in line with the delivery pipe 106. The pump 110 can be of a type similar to those discussed above with reference to the pump 98, or other known pump types capable of pumping liquid. The pump 110 can be actuated manually or pneumatically.

Thus, the above described optional structure for delivering liquid medium provides an alternative to adding the liquid medium through the loading opening 40 or another location on the cylinder 12. The above described structure remains generally fixed in place, and does not rotate along with the cylinder 12.

In practice, to supply the liquid medium from the tank 100, the cylinder 12 is preferably in a stationary position. Further, the cylinder 12 is preferably rotated to a position such that the discharge housing 18 is located above the axis A. This location of the discharge housing 18 is beneficial because it results in the grinding media being disposed generally below the discharge housing 18, from which the liquid medium will be entering the cylinder 12. In this approach, the liquid medium will not have to flow against backpressure caused by gravity or by its flow through a tortuous path defined by the grinding media. However, the discharge housing 18 could also be located below the axis A when delivering the liquid medium into the cylinder 12 if desired or if necessary.

While the above description relates to the cylinder 12 being stationary during delivery of the liquid medium, the delivery of liquid medium from the tank 100 could also be performed while the cylinder 12 is rotating, if desired or necessary.

To deliver the liquid medium, the valve 108 is set such that the delivery pipe 106 is in fluid communication with the secondary pipe 86, and the path toward the separator tank 90 is blocked. The valve 60 is similarly set to the open position to allow liquid medium to flow therethrough. The pump 110 is actuated, drawing liquid medium from the tank 100 and pumping it through the delivery pipe 106 toward the secondary pipe 86. Liquid will enter secondary pipe 86 and flow toward the rotary union 80, where it will then flow into the conveying pipe 20. The liquid medium will continue through the conveying pipe 20 and through the valve 60, where it will then enter the discharge housing 18. The liquid medium will then flow through the discharge grate 14, which is open to the cavity 26 of the cylinder 12, and into the cylinder 12.

When delivery of the liquid medium to the cylinder 12 is complete, the pump 110 can be de-activated and valve 60 can be closed. Valve 108 can then be moved to the position where the delivery pipe 106 is blocked and flow through the secondary pipe 86 toward the separator tank 90 is re-established.

In one approach, the valve 108 is disposed between the pump 98 and the rotary union 80. In another approach, the valve 108 can be disposed between the pump 98 and the separator tank 90. In this approach, the pump 98 could be used to draw liquid from the tank 100 and through the delivery pipe 106 toward the conveying pipe 20 if the pump is capable of reversing the direction of the flow. The pump 98 can also be used to pump out liquid medium that was not ultimately delivered to the cylinder 12 by pumping the liquid medium as if it were the liquid medium being discharged.

In the case where the pump 98 is between the valve 110 and separator tank 90, and not part of the path through which the liquid medium is delivered from the tank 100 to the cylinder, the pump 110 could be used to pump liquid medium back into the tank 100 if the pump 110 is capable of two-direction pumping.

As a person skilled in the art will readily appreciate, the above description is meant as an illustration of implementation of the principles this invention. This description is not intended to limit the scope or application of this invention in that the invention is susceptible to modification, variation, and change, without departing from the spirit of this invention, as defined in the following claims.

What is claimed is:

1. A rotary milling system comprising:

a rotatable cylinder defining a cavity and a central longitudinal axis;

a discharge grate provided on a sidewall of the cylinder and defining an opening to allow milled product to pass therethrough;

a liquid-tight discharge housing surrounding the discharge grate and defining a cavity therein;

a first valve connected to an outlet of the discharge housing, the first valve being moveable between a closed position and an open position to selectively allow milled product disposed in a liquid to pass through the first valve when open while preventing passage when closed;

a conveying pipe in fluid communication with an outlet side of the first valve;

a liquid-drawing apparatus operatively associated with the conveying pipe and disposed downstream of the discharge housing to draw the milled product in the conveying pipe away from the discharge housing;

a separator tank connected to a secondary pipe downstream of and in fluid communication with the conveying pipe, the separator tank being located downstream of the rotatable cylinder, wherein the liquid drawing apparatus is in fluid communication with the separator tank; and, a second valve disposed in line with the secondary pipe and being located downstream of the rotatable cylinder and upstream of the separator tank.

2. The system of claim 1 further comprising a rotary union connected with the conveying pipe.

3. The system of claim 2 wherein the secondary pipe is connected to the rotary union, wherein the rotary union couples the secondary pipe and the conveying pipe.

4. The system of claim 1, wherein the first valve is one of a ball valve, pinch valve, or gate valve.

5. The system of claim 1, wherein the opening of the discharge grate is always open and provides fluid communication between the discharge housing and the cavity of the rotatable cylinder, allowing fluid to pass between the discharge housing and cylinder during rotation of the cylinder while blocking solid grinding media from passing through the discharge grate.

6. The system of claim 1, wherein the first valve is manually operated between the open and closed positions.

7. The system of claim 1, wherein the first valve is pneumatically operated.

8. The system of claim 1 further comprising:

a liquid delivery pipe extending from the second valve and in fluid communication with a tank for housing liquid medium to be delivered to the rotatable cylinder, wherein the liquid delivery pipe is configured to deliver liquid medium to the rotatable cylinder through the secondary pipe and conveying pipe;

wherein the second valve has a first position where the liquid delivery pipe is blocked from the secondary pipe and a second position where the liquid delivery pipe is in fluid communication with the secondary pipe.

9. The system of claim 8, further comprising a pump disposed in line with the liquid delivery pipe and being located downstream of the tank and upstream of the second valve for pumping liquid medium from the tank toward the rotatable cylinder.

10. The system of claim 1, wherein the liquid drawing apparatus is a blower coupled to the separator tank.

11. The system of claim 1 wherein the liquid drawing apparatus is a pump located downstream of the rotatable cylinder and upstream of the separator tank and connected in line with the secondary pipe.

12. The system of claim 1, further comprising first and second trunion members for supporting the cylinder for rotation about the central axis, wherein the conveying pipe extends into and through the first trunion member.

13. A method for milling product in a rotary mill that includes a cylinder comprising:

rotating the cylinder in which a plurality of grinding media, liquid medium, and product to be milled are disposed;

grinding the product to be milled to produce a milled product and suspending the milled product in the liquid medium while grinding;

discharging the liquid medium and milled product through a discharge grate disposed on the cylinder from the cylinder into a discharge housing that surrounds the discharge grate;

opening a first valve that is connected to a conveying pipe, wherein the first valve is in fluid communication with the discharge housing and the conveying pipe to permit fluid to flow from the discharge housing to the conveying pipe;

discharging the liquid medium and milled product from the discharge grate into the conveying pipe; and actuating a liquid-drawing apparatus to draw the liquid medium and milled product out of and away from the discharge housing and through the conveying pipe to a secondary pipe downstream of and in fluid communication with the conveying pipe and into a separator tank after passing through a second valve.

14. The method of claim 13 further comprising rotating the cylinder while the first valve is open and the liquid-drawing apparatus is actuated.

15. The method of claim 13 further comprising transferring liquid medium back and forth between the discharge housing and the cylinder through the discharge grate while rotating the cylinder.

16. The method of claim 15, wherein the first valve is closed while transferring liquid medium back and forth through the discharge grate.

17. The method of claim 13, wherein the cylinder, discharge housing, discharge grate, conveying pipe, and first valve rotate together about a central axis and relative to a stationary secondary pipe and separator tank, and the secondary pipe is coupled to the conveying pipe via a rotary union.

18. The method of claim 17, wherein the liquid-drawing apparatus is a pump connected in line with the secondary pipe.

19. The method of claim 13 further comprising, prior to rotating the cylinder, delivering liquid medium from a tank into the cylinder, wherein the liquid medium is pumped through a delivery pipe extending from the tank and further through the conveying pipe toward and through the discharge housing and discharge grate into the cylinder.

* * * * *